United States Patent [19]

Schnell

[11] Patent Number: 4,775,108

[45] Date of Patent: Oct. 4, 1988

[54] ARRANGEMENT FOR AUTOMATIC DISPLACEMENT OF A CUTTER SET OF A MEAT COMMINUTING MACHINE

[75] Inventor: Karl Schnell, Winterbach, Fed. Rep. of Germany

[73] Assignee: Karl Schnell Maschinenfabrik, Winterbach, Fed. Rep. of Germany

[21] Appl. No.: 62,175

[22] Filed: Jun. 12, 1987

[30] Foreign Application Priority Data

Jun. 19, 1986 [DE] Fed. Rep. of Germany ..... 3620598

[51] Int. Cl.[4] ..... B02C 18/38

[52] U.S. Cl. ..... 241/37; 241/82.5

[58] Field of Search ..... 241/82.1–82.7, 241/37, 30, 35

[56] References Cited

U.S. PATENT DOCUMENTS

| | | | |
|---|---|---|---|
| Re. 10,717 | 4/1886 | Shaw | 241/82.2 |
| 3,610,541 | 10/1971 | Gudaz | 241/37 |
| 3,912,434 | 10/1975 | Nagahara et al. | 241/37 X |
| 4,295,420 | 10/1981 | Satake et al. | 241/37 X |

*Primary Examiner*—Mark Rosenbaum

*Attorney, Agent, or Firm*—Erwin S. Teltscher; Horst M. Kasper

[57] ABSTRACT

A meat comminuting machine has a cutting unit which includes at least one stationary perforated plate and a mobile associated cutter head arranged on a driving shaft, which is driven by a driving motor, and a device for an axial displacement of the driving shaft which supports the cutter head in dependence of the loading of the driving motor.

17 Claims, 2 Drawing Sheets

ARRANGEMENT FOR AUTOMATIC DISPLACEMENT OF A CUTTER SET OF A MEAT COMMINUTING MACHINE

BACKGROUND OF THE INVENTION

The present invention relates to the meat comminuting machine, and more particularly it relates to a meat comminuting machine which has has a cutting unit with at least one stationary perforated plate and a replaceable cutter head, which is associated with the perforated plate and arranged on a shaft drivable by a motor.

Meat comminuting machines of the above-noted general type, are known in the art. A known meat comminuting machine has been known to be afflicted with the problem that the cutter blades which are provided on the cutter head and operate with the perforated blade are subjected to a very fast wear, particularly during a continuous running of the comminuting machine. This means, however, that the individual cutter blades must be ground within a relatively short time, so that the required grinding not only involves additional working expenses, but also requires every time a special disassembly of the respective cutter head and subsequent reinstallation of the same. Moreover, this brings about that the comminuting machine is out of service at such times, which leads to further disturbances of the operation, as well as resulting in a heavy work load of the respective machine.

SUMMARY OF THE INVENTION

Accordingly, it is an object of the present invention to provide a meat comminuting machine which avoids the disadvantages of the prior art.

More particularly, it is an object of the present invention to provide a meat comminuting machine, in which a cutting unit can be so adjusted during idle running, that any unnecessary wear of the cutter blades provided on the cutter head is eliminated.

In keeping with these objects and with others which will become apparent hereinafter, one feature of the present invention resides, briefly stated, in that a drive shaft which carries a cutter head provided with cutter blades is axially adjustable in dependence upon the respective loading of a motor, which drives the machine. In accordance with the present invention, in the event of a predetermined minimum loading of the driving motor the cutter blades of the cutter head tightly abut the opposite cutting surfaces of the neighboring perforated plate, while in the event of a reduction of this loading, the cutter blades of the cutter head are lifted from the perforated plate.

For preventing any undesirable displacement of the driving shaft in an axial direction, it is further provided in accordance with another feature of the present invention, that when the axially displaceable driving shaft is in its extended position and in its retracted position it is arrestable, for example by means of an electronically controlled clamping device, which can be actuated pneumatically, hydraulically or electromagnetically.

In accordance with an especially advantageous feature of the the present invention, a threaded sleeve is supported on the longitudinally displaceable driving shaft and abuts against the shaft in the axial direction via, for example a circular disk, a circular collar or the like. The threaded sleeve is rotatable by means of an adjusting or displacement motor, and its outer thread engages into an inner thread of a stationary bearing bush, which surrounds the threaded sleeve. The threaded sleeve is turnable relative to the stationary bearing bush, so that the threaded sleeve and the driving shaft together with the latter are imparted an axial displacement which leads to a respective lifting of the cutter blades of the cutter head from the oppositely located perforated plate for setting of the cutter blade with respect thereto.

In connection with this, the above-mentioned threaded sleeve can also partially extend in an axial direction beyond the stationary bearing bush which surrounds it, and merge in this region into a cylindrical casing for tightly engaging a clamping ring of the above-mentioned clamping device. The clamping ring of the clamping device fixes in its clamping position the threaded sleeve and also the driving shaft which supports the cutter head in its respective position. In contrast, in an opening position the clamping ring allows rotation of the threaded sleeve by means of the adjusting motor and thereby an axial displacement of the driving shaft.

In accordance with still a further feature of the present invention it is advantageous when the above-mentioned threaded sleeve is connected with a worm wheel or the like arranged coaxially with the threaded sleeve, while the worm wheel engages with a worm shaft driven by the adjusting motor.

Moreover, so as to allow a required new adjustment of the cutter head relative to the associated perforated blade following the grinding of the cutter blades of the cutter head, the worm shaft of the adjusting motor is provided advantageously with a position-adjustable handle or the like for displacement of the driving shaft which supports the cutter head.

The novel features of the present invention are set forth in particular in the appended claims. The invention itself, however, both as to its construction and method of operation, will be best understood from the following description of the preferred embodiments which is are illustrated in the appended drawings.

DESCRIPTION OF A PREFERRED EMBODIMENT

Figure 1:
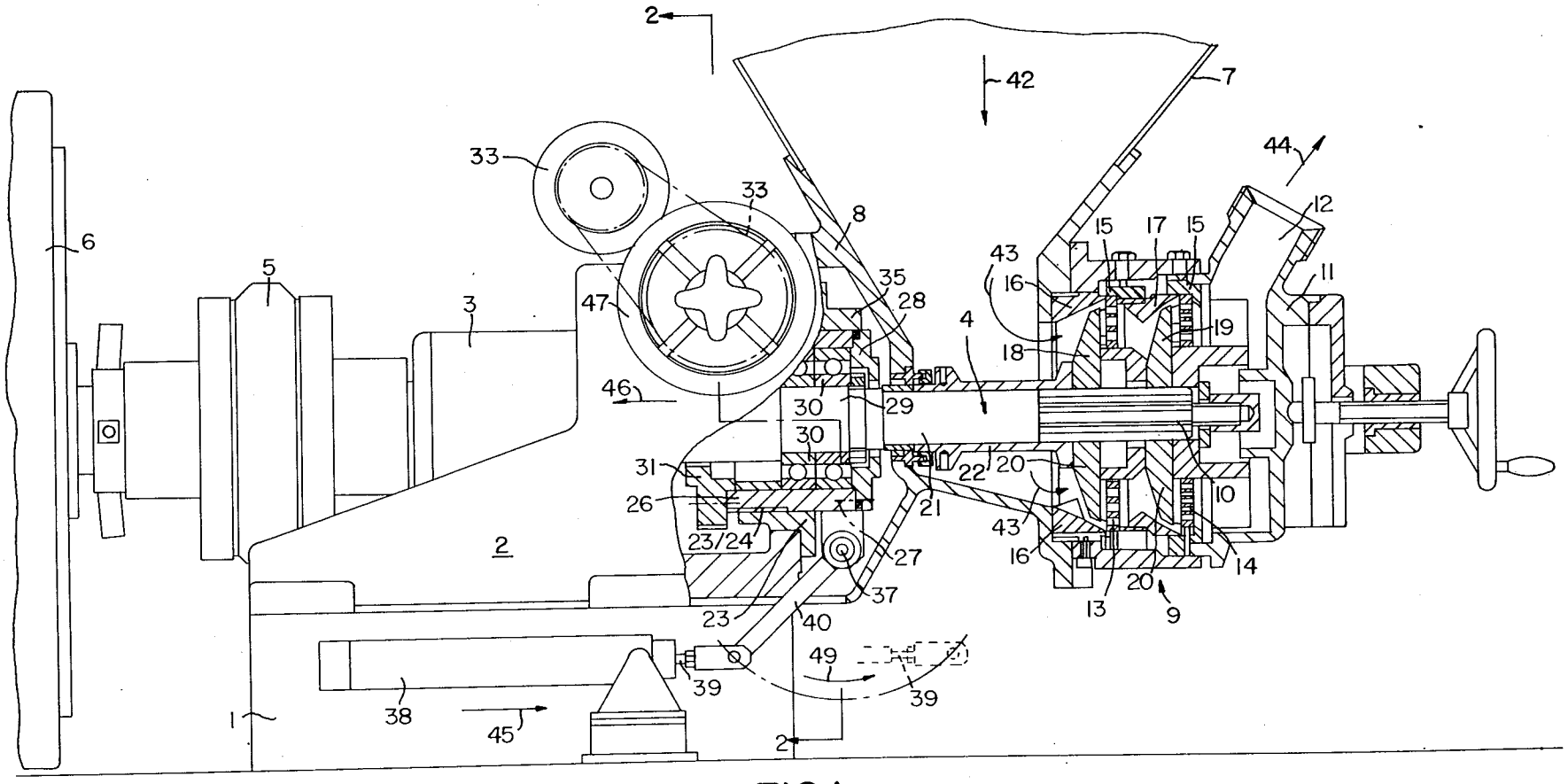
FIG. 1 is a side view of a meat comminuting machine with an adjusting device, in accordance with the present invention.

A meat comminuting machine shown in a side view in FIG. 1 has a base 1 and a machine housing arranged on the base 1 and identified with the reference numeral 2. A bearing housing 3 is formed on the machine housing 2 and serves for receiving and supporting a driving shaft identified with the referenced numeral 4. The driving shaft 4 is driven in a rotation by an electric motor 6 via an elastic coupling 5.

An inlet housing 8 is formed on the machine housing 2, and more particularly at a side which faces away from the electric motor 6. The inlet housing 8 is provided with a funnel 7. A cutting head identified with reference number 9 is arranged near the inlet housing 8 at a side which faces away from the electric motor 6. The driving shaft 4 and more particualarly its end identified with referenced numeral 10 extends through the cutting head 9. The cutting head 9 is covered by an outlet housing 11, which, in turn, is provided with a discharge opening identified with the reference numeral 12.

The cutting head 9 has two stationary perforated plates 13 and 14 which are located one behind the other in a axial direction. The perforated plates are fixed by means of a ring holder 15, an abutting finger-ring 16, and a supporting ring 17 located between the perforated blade 13 and 14. The perforated plates 13 and 14 are associated with cutter heads identified with the reference numerals 18 and 19. Each cutter head is provided with a plurality of cutter blades 20. The cutter heads 18 and 19 are arranged on the free end 10 of the driving shaft 4 and arrested thereon. A shaft portion 21 which is located near the shaft end 10 and extends through the inlet housing 8, is covered by a sleeve 22 which rotates together with the driving shaft 4.

As can be seen from FIG. 1, the machine housing 2 serves for supporting a stationary bearing bush 23 provided with an inner thread 24. A rotatable threaded sleeve 26 provided with an outer thread 25 is partially threaded into the bearing bush 23. A part 27 of the threaded sleeve 26, which projects beyond the stationary bearing bush 23, is cylindrical and abuts via a ring cover 28 against an outer surface of the driving shaft 4. A part 29 of the driving shaft 4 is supported in the threaded sleeve 23 by means of ball bearings 30.

A worm wheel identified with reference numeral 31 is mounted on a part of the threaded bush 26 which is opposite to the part 27. A worm shaft 34 engages with the worm wheel 31. The worm shaft 34 is driven in rotation by an adjusting motor 32 by chain wheels 33.

Figure 2:
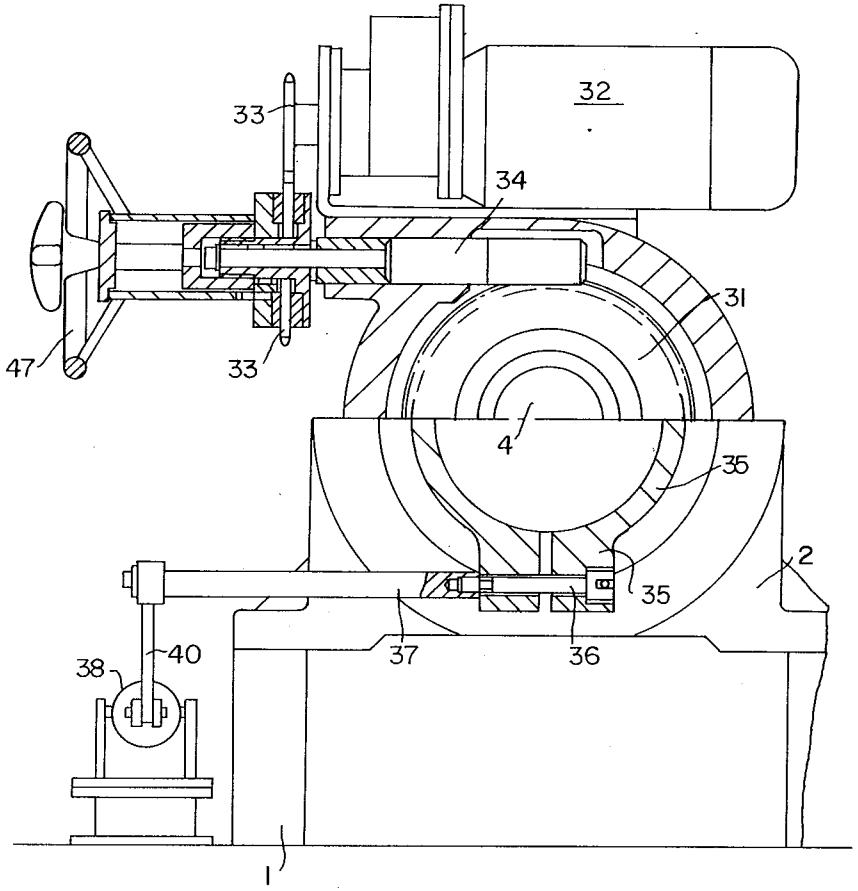
FIG. 2 is a view showing a section taken along the line 2—2 in FIG. 1.

As can be seen further from FIGS. 1 and 2, a clamping ring 35 tightly surrounds the cylindrical part 27. The clamping ring 35 is a part of a clamping device, and can be tightened or loosened by means of a clamping ring identified by the reference numeral 36 and an associated clamping nut 37. The tightening and loosening of the clamping ring 35 is performed by a pneumatic cylinder-piston unit, which has a cylinder 38 and a piston rod 39. The latter is articulately connected with a crank 40 arranged so that during a stroke of a piston 39, the crank 40 performs a turning movement in the direction of the arrow 41. Depending on the direction of rotation of the crank, a pulling or a releasing of the clamping nut 37 is performed, resulting in a respective tightening or release of the clamping ring 35.

The meat comminuting machine in accordance with the present invention operates in the following manner:

In the working position of the driving shaft 4 and the cutting heads 18 and 9 arranged thereon, as is shown in FIG. 1, the piston 39 assumes its extended operative position in which the clamping nut 37 and clamping ring 35 are tightened. The clamping ring 35 tightly engages along the cylindrical part 27, so that rotation of the threaded sleeve 26 is not possible. Thereby the driving shaft 4 is prevented from any axial displacement. In this working position of the driving shaft 4, the goods to be comminuted are supplied along the direction of the arrow 42 into th funnel 7, wherefrom they are transported in the direction of the arrow 43 to the cutter heads 18 and 19 and the associated perforated plates 13 and 14, and after cutting are withdrawn in direction of the arrow 44 through the discharge opening 12 of the outlet housing 11.

Figure 4:
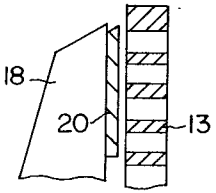
FIG. 4 is a view substantially corresponding to the view of FIG. 3, but showing the cutting unit with the lifted cutter blades.

When a further supply of the product to be cut takes place in direction of the arrow 42, the loading of the electric motor 6 is reduced. When the loading falls below a minimum loading, the piston rod 39 performs a stroke in direction of the arrow 45 by an electronic control, and thereby the crank 40 performs a turning movement in the direction of the arrow 41. This leads to a release of the clamping nut 37, and thereby also of the clamping ring 35 as well as to a release of the threaded sleeve 26. Subsequently the adjustment motor 32 is driven in rotation by an control electronic device. This rotation leads to a rotation of the threaded sleeve 26 via the worm shaft 34, and the worm wheel 31, and therefore leads to an axial displacement of the threaded sleeve 26 relative to the stationary bearing bush 23. As a result of the displacement of the threaded sleeve 26 in the direction of arrow 46, the driving shaft 4 together with both cutter heads 18 and 19 is retracted, and thereby the cutter blades 20 are lifted from the cutting surfaces of the oppositely diposed perforated plates 13 and 14 as shown in FIG. 4. When this axial displacement of the driving shaft 4 ends, the piston rod 39 returns to its initial or operative position. Thereby the clamping ring 35 is again clamped, and therefore the threaded sleeve 26 and the driving shaft 4 associated therewith are arrested.

Figure 3:
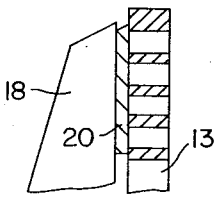
FIG. 3 is a fragmentary view of FIG. 1 on an enlarged scale and showing a cutting unit with set cutter blades.

After the meat comminuting machine has been idling for a shorter or longer time, and again goods to be comminuted are supplied in the direction of the arrow 42 into the funnel 7, the loading of the electric motor 6 is again increased. As soon as the predetermined minimal loading of the electric motor 6 is exceeded, the electronic control again acts so as to release the clamping ring 35 as well as to turn the threaded sleeve 26. This leads to a displacement of the driving shaft 4 and the cutter heads 18 and 19 arranged on it in a direction opposite to the direction of the arrow 46. The cutter blades 20 of both cutter heads 18 and 19 assume again the working position shown in FIG. 3, in which the blades tightly abut again the cutting surfaces associated with the perforated plates 13 and 14. After the piston rod 39 is again returned to its inoperative position, the clamping ring 35 is again clamped, so that both the threaded sleeve 26 and the driving shaft 4 with both cutter heads 18 and 19 are secured against any further axial displacement.

To cope with a possible grinding of the cutter blades 20 of the cutter heads 18 and 19, the cutter blades 20 must be capable of being adjusted reliably and "with a feel" relative to the cutting surfaces of the neighboring perforated plates 13 and 14. For this purpose the worm wheel 34 is provided with a handle which is identified with the reference numeral 47. The adjustment motor 32, the driving shaft 4, and thereby both cutter heads can be axially displaced in a manual mode by the handle 47, independently of the adjusting motor 32.

The invention is not limited to the details shown since various medications and structural changes are possible without departing in any way from the scope of the present invention.

What is intended to be protected by Letters Patent is set forth in the appended claims.

I claim:

1. A meat comminuting machine, comprising a cutting unit including at least one stationary perforated plate, and a movable cutter head associated with the perforated plate;

drive means for moving said cutter head, and including a driving shaft which supports said cutter head, and a driving motor which drives said driving shaft, said driving shaft being displaceable between an extended working position in which said cutter head abuts against said perforated plate and a retracted idling position in which said cutter head is lifted from said perforated plate; and means for axially displacing said driving shaft and therefore said cutter head supported thereby in dependence upon a loading of said driving motor, so that in case of a predetermined minimum loading of said driving motor said driving shaft is displaced to said extended working position and said cutter head abuts against said perforated plate, while upon reduction of said loading said driving shaft is displaced to said retracted idling position and said cutter head is lifted from said perforated plate.

2. A meat comminuting machine as defined in claim 1, wherein said cutter head has a plurality of cutter blades, said perforated plate having a cutting surface which is opposite to said cutter blades, said displacing means being formed so that in case of a predetermined minimum loading of said driving motor said cutter blades of said cutter head tightly abut against said cutting surface of said perforated plate, while upon reduction of said loading, said cutter blades of said cutter head are lifted from said cutting surface of said perforated plate.

3. A meat comminuting machine as defined claim 1, wherein said driving shaft is axially displaceable between said extended position and said retracted position and fixable in said positions; and further comprising clamping means for fixing said driving shaft in said positions.

4. A meat comminuting machine as defined in claim 3 wherein said clamping means is formed as an electronically controlled means, and further comprising means for electronically controlling said clamping means.

5. A meat comminuting machine as defined in claim 3, wherein said clamping means is pneumatically activated, and further comprising pneumatic means for activating said clamping means.

6. A meat comminuting machine as defined in claim 3, wherein said clamping means is hydraulically actuated, and further comprising hydraulic means for actuating said clamping means.

7. A meat comminuting machine as defined in claim 3, wherein said clamping means is electro-magnetically activated; and further comprising electro-magnetic means for actuating said clamping means.

8. A meat comminuting machine as defined in claim 3, and further comprising a threaded sleeve arranged on said driving shaft and abutting against the latter in an axial direction; an adjusting motor arranged to turn said threaded sleeve; and a stationary bearing bush surrounding said threaded sleeve and threadingly engaging the latter.

9. A meat comminuting machine as defined in claim 8, wherein said threaded sleeve has an outer thread, said bearing bush having an inner thread, said outer thread of said threaded sleeve engaging with said inner thread of said bearing bush.

10. A meat comminuting machine as defined in claim 8; and further comprising an annular disk, said threaded sleeve abutting via said annular disk against said driving shaft in an axial direction.

11. A meat comminuting machine as defined in claim 8; and further comprising a ring collar, said threaded sleeve abutting via said ring collar against said driving shaft in an axial direction.

12. A meat comminuting machine as defined in claim 8, wherein said clamping means includes a clamping ring, said threaded sleeve extending in an axial direction partially beyond said bearing bush so as to form a cylindrical casing, said cylindrical casing tightly surrounding said clamping ring of said clamping means.

13. A meat comminuting machine as defined in claim 8; and further comprising a member connected with said threaded sleeve and arranged co-axially therewith; and a worm shaft driven by said adjusting motor and engaging with said member.

14. A meat comminuting machine as defined in claim 13, wherein said member which is connected with said threaded sleeve is a worm wheel which engages with said worm shaft.

15. A meat comminuting machine as defined in claim 14; and further comprising manual means associated with said worm shaft and allowing a manual displacement of said driving shaft which supports said cutter head.

16. A meat comminuting machine as defined in claim 15, wherein said manual means is formed as a handle associated with said worm wheel.

17. A meat comminuting machine as defined in claim 1, wherein said driving shaft is fixable at least in said extended working position; and further comprising means for fixing said driving shaft in said extended working position.

* * * * *